US011384452B2

(12) United States Patent
Solberg et al.

(10) Patent No.: US 11,384,452 B2
(45) Date of Patent: Jul. 12, 2022

(54) ELECTROSPINNING DEVICE AND METHOD

(71) Applicant: Innovative Mechanical Engineering Technologies B.V, Waalre (NL)

(72) Inventors: Ramon Hubertus Mathijs Solberg, Munstergeleen (NL); Marc Simonet, Eindhoven (NL); Paul Johannes Franciscus Maria Janssen, Eindhoven (NL)

(73) Assignee: Innovative Mechanical Engineering Technologies B.V., Waalre (NL)

( * ) Notice: Subject to any disclaimer, the term of this patent is extended or adjusted under 35 U.S.C. 154(b) by 0 days.

(21) Appl. No.: 16/756,474

(22) PCT Filed: Oct. 19, 2018

(86) PCT No.: PCT/NL2018/050688
§ 371 (c)(1),
(2) Date: Apr. 16, 2020

(87) PCT Pub. No.: WO2019/078720
PCT Pub. Date: Apr. 25, 2019

(65) Prior Publication Data

US 2021/0198808 A1 Jul. 1, 2021

(30) Foreign Application Priority Data

Oct. 19, 2017 (NL) ..... 2019764

(51) Int. Cl.
*D01D 5/00* (2006.01)
*D04H 1/728* (2012.01)

(52) U.S. Cl.
CPC ..... *D01D 5/0076* (2013.01); *D01D 5/0023* (2013.01); *D01D 5/0038* (2013.01); *D01D 5/0092* (2013.01); *D04H 1/728* (2013.01)

(58) Field of Classification Search
CPC .. D01D 5/0076; D01D 5/0023; D01D 5/0038; D01D 5/0092
See application file for complete search history.

(56) References Cited

U.S. PATENT DOCUMENTS 2,187,306 A * 1/1940 Formhals ..... D01D 5/0076 428/375
3,320,479 A * 5/1967 Owens ..... D01D 5/04 361/230

(Continued)

FOREIGN PATENT DOCUMENTS

WO 2013106822 A1 7/2013

*Primary Examiner* — Niki Bakhtiari
*Assistant Examiner* — Emmanuel S Luk
(74) *Attorney, Agent, or Firm* — N.V. Nederlandsch Octrooibureau

(57) ABSTRACT

An electrospinning device (1; 30) is provided comprising:
- a container (2) for holding a liquid comprising a polymer melt or a polymer solution;
- a nozzle (3) arranged to outlet a stream of the liquid from the container;
- a collecting surface (4) for collecting electro spun material coming from the nozzle during an electrospinning process so as to form a fibrous structure (8) on the collecting surface (4);
- a voltage supply system (5) arranged to create a voltage difference between the nozzle and the collecting surface (4),
- one or more electrostatic emitters (10; 38) arranged to locally distribute positive and/or negative ions onto the fibrous structure, and
- one or more rotatable bodies (6; 36) arranged to cause the collecting surface (4) to face the nozzle (3) and the electrostatic emitters (10; 38) in turn.

9 Claims, 4 Drawing Sheets

(56) References Cited

Figure 1:
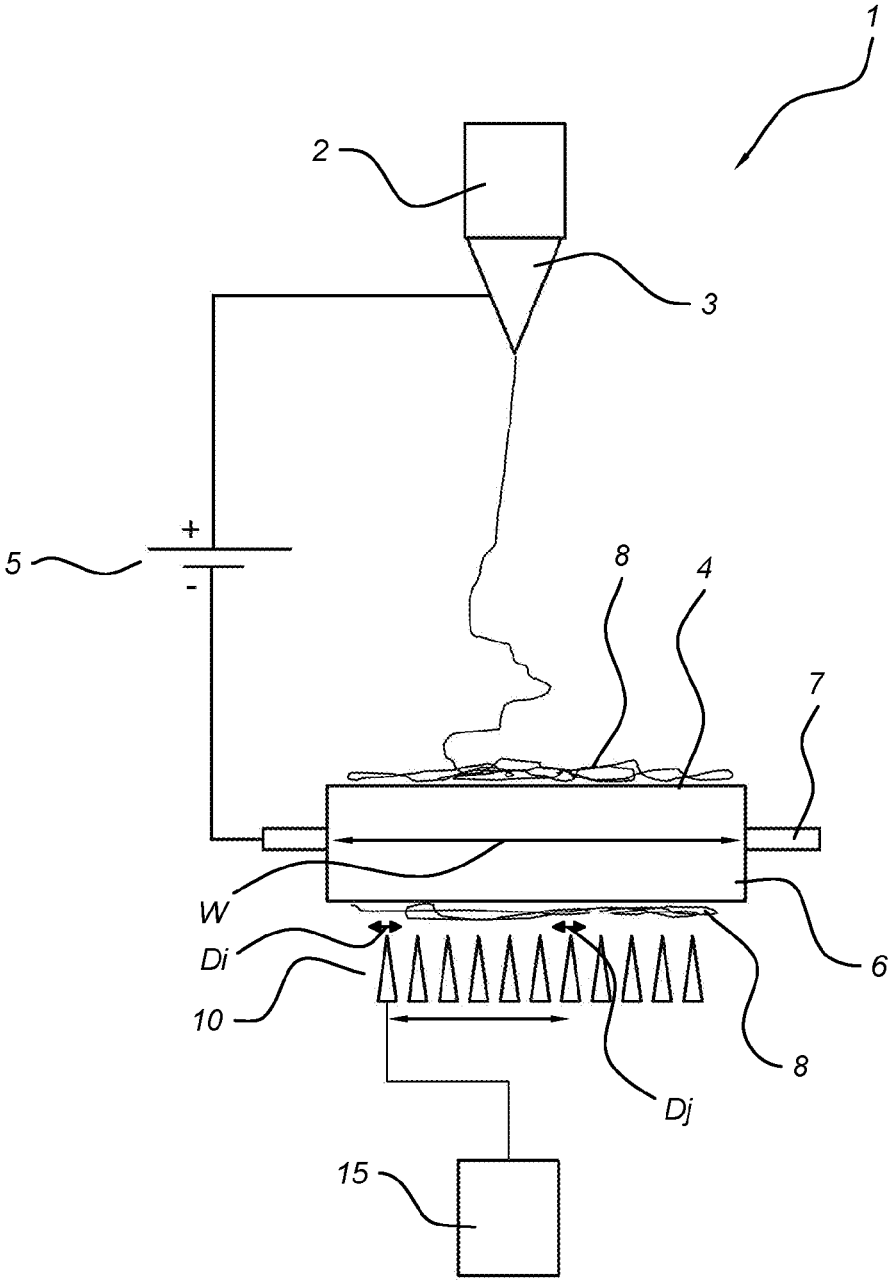

U.S. PATENT DOCUMENTS 3,689,608 A * 9/1972 Hollberg ..... D04H 3/16 264/441
5,254,297 A * 10/1993 Deeds ..... B01D 39/04 264/464
5,296,172 A * 3/1994 Davis ..... B29C 48/05 264/441
5,643,524 A * 7/1997 Gilbert De Cauwer . D01D 5/11 264/205
7,993,567 B2 * 8/2011 Scott-Carnell ..... D01D 5/0084 264/484
10,640,888 B1 * 5/2020 Haff ..... B05B 5/082
2002/0090725 A1 * 7/2002 Simpson ..... D01F 1/10 435/402
2005/0104258 A1 5/2005 Lennhoff
2005/0224999 A1 10/2005 Andrady et al.
2007/0042069 A1 2/2007 Armantrout et al.
2009/0091065 A1 * 4/2009 Katti ..... D01D 5/0076 264/465
2011/0101571 A1 * 5/2011 Reneker ..... D01F 1/106 264/465
2012/0013047 A1 1/2012 Ishikawa et al.
2012/0232224 A1 * 9/2012 Honda ..... D01D 5/0038 525/333.6
2013/0337101 A1 * 12/2013 McGrath ..... B29C 48/142 425/174.8 E
2014/0162521 A1 * 6/2014 Chen ..... D04H 1/728 442/338
2014/0284827 A1 * 9/2014 Pokorny ..... D01D 5/0007 264/6
2015/0315724 A1 11/2015 Kocis et al.
2016/0047064 A1 * 2/2016 Khandaker ..... A61C 13/0006 264/16
2016/0325480 A1 * 11/2016 Soletti ..... A61F 2/06
2017/0260652 A1 * 9/2017 Kinoshita ..... B29C 48/142
2017/0268142 A1 * 9/2017 Tokuno ..... D04H 1/728
2018/0223451 A1 * 8/2018 King ..... D01D 5/0069
2018/0368968 A1 * 12/2018 Leeson ..... A61L 27/3604
2019/0127884 A1 * 5/2019 Lee ..... A61L 31/044
2019/0292686 A1 * 9/2019 Kimiya ..... D01D 5/0069
2019/0338445 A1 * 11/2019 Haff ..... D01D 5/0084

* cited by examiner

ELECTROSPINNING DEVICE AND METHOD

FIELD OF THE INVENTION

The invention relates to an electrospinning device for producing a fibrous structure. The invention also relates to method of electrospinning.

BACKGROUND ART

U.S. patent publication US2005/224999 discloses an electrospinning device for producing fibrous materials. The device has an extrusion element configured to electrospin a substance using an electric field extraction of the substance from a tip of the extrusion element, a collector, and a chamber enclosing the collector and extrusion element. An ion generator is present to generate ions for injection into a Rayleigh instability zone in the chamber during operation of the device.

US patent publication US2007/042069 discloses a fiber spinning apparatus for charging a polymer-containing liquid stream using a point-electrode positioned adjacent the intended path of the liquid stream during operation. E.g. an ion flow is generated by a corona discharge to impart electrical charge to the polymer-containing liquid stream.

US patent publication US2005/104258 discloses an electrospinning device allowing to direct a polymer from a source electrode into an electric field that drives the formation of electrospun fibers that are deposited onto a collecting surface (being a counter electrode or a collecting surface between the source electrode and a counter electrode). Multiple electrically charged areas underneath the counter electrode allow to produce a pattern of areas where fibers are collected.

Electrospinning is a method to produce continuous fibers with a diameter ranging from a few tens of nanometers to a few tens of micrometers. To electrospin fibers, a suitable liquefied material may be fed through a small, electrically conductive nozzle. The liquefied material may be electrically charged by applying a high voltage between the nozzle and a counter electrode. The generated electric field causes a cone-shape deformation of the droplet at the nozzle tip. Once the surface tension of this droplet is overcome by the electrical force, a jet is formed out of the droplet and a fiber forms that moves towards the counter electrode. During the flight towards the counter electrode the fiber is continuously stretched and elongated by the different forces acting on it, reducing its diameter and allowing it to solidify by evaporation of the solvent or cooling of the material such that a solid fiber is deposited on the collector which is placed before the counter electrode or the counter electrode is used as collector directly.

Electrospinning uses an electric field, generated by a high voltage potential between nozzle and collector, to produce a fiber from a droplet at the nozzle tip. In alternative configurations fibers are drawn e.g. from a liquid bath, liquid covered ball, liquid filled opening or liquid covered wire. After stretching, the fiber is deposited on the collector surface. However, even with conductive collector surfaces, residual electric charges might remain inside the deposited fiber. These residual charges have an adverse effect on the process since they act as a repulsive force on the subsequent section of the fiber arriving at the collector. These residual charges are not always easy to remove efficiently, even with conductive collectors. Eventually, fibers are not in direct contact with the collector anymore but with underlying, poorly conducting fibers.

Several methods are proposed to improve the removal/neutralization of residual charges at the deposited fibrous structure. However, these methods rely on either reducing charge on the fiber in mid-air, or bombarding the collector surface with ions to alter the charge on the fibrous structure, see e.g. patent publication WO2016/147951. In WO2016/147951 a nanofiber manufacturing apparatus is described equipped with a collecting unit, a discharging unit, a power source unit, and an electricity-removing unit. The collecting unit dispenses a deposit-receiving material from one end and collects same at the other end. The discharging unit discharges a feedstock liquid and deposits nanofibers on a collecting surface. The power source unit generates a potential difference between the discharging unit and the collecting surface. The electricity-removing unit removes the charge with which the deposited nanofibers are charged. Rotatable bodies cause the collecting surface to face the discharging unit and the electricity-removing unit alternately. The electricity-removing unit extends across the whole width of the collecting surface.

SUMMARY OF THE INVENTION

It is on object of the present invention to provide an improved electrospinning device.

A first aspect of the invention provides an electrospinning device comprising:

- a container for holding a liquid comprising a polymer melt or a polymer solution;
- a nozzle arranged to outlet a stream of the liquid from the container;
- a collecting surface for collecting electro spun material coming from the nozzle during an electrospinning process so as to form a fibrous structure on the collecting surface;
- a voltage supply system arranged to create a voltage difference between the nozzle and the collecting surface,
- one or more electrostatic emitters arranged to locally distribute positive and/or negative ions onto the fibrous structure and collector surface, and
- one or more rotatable bodies arranged to cause the collecting surface to face the nozzle and the electrostatic emitters in turn.

The present invention deploys the known technique of using ions to alter the charge on the deposited fibrous structure in a local manner. To obtain this, the one or more electrostatic emitters may be relatively small and positioned close to the surface of the collecting surface/fibrous structure, and have e.g. an effective area around the emitters with a radius of only 5-10 mm. This new technique offers precise control over the attractiveness/repulsiveness of certain areas of the collector/fibrous structure for subsequent fiber deposition. This enables a local built up of fibers, which enables patterning of the fibrous structure. So what was regarded previously as a problem (i.e. built up of charge in the fibrous structure during manufacturing) is now used by the inventors to its advantage.

Optionally, the device comprises a rotatable cylindrical body, the surface of which forms the collecting surface.

Optionally, the device comprises at least two rotatable bodies, and a looped conveyer belt arranged around the two rotatable bodies, wherein the surface of the belt forms the collecting surface.

Optionally, the collecting surface is arranged between the nozzle and the one or more electrostatic emitters. This allows to have the collecting surface, in combination with the rotatable bodies to face in turn (i.e. subsequently) the nozzle and the one or more electrostatic emitters. Furthermore, as in this embodiment, the electrostatic emitters are located at the opposite side from the collecting surface when viewed from the nozzle, the electrostatic emitters will have less influence on the area in the electrospinning device where the fibers are formed from the jet exiting the nozzles (the Rayleigh instability area).

Optionally, the electrostatic emitters are arranged in a row.

Optionally, the electrostatic emitters are arranged in an array.

Optionally, the electrostatic emitters are movable in a direction parallel to a rotation axis of the rotatable body or bodies.

Optionally, the electrostatic emitters comprise ion generators.

Optionally, the device comprises a control unit arranged to control the electrostatic emitters so as to create a pattern into the fibrous structure.

According to a further aspect there is provided a method of electrospinning comprising:

- holding a liquid comprising a polymer melt or a polymer solution in a container;
- letting out a stream of the liquid from the container through at least one nozzle;
- creating a voltage difference between the nozzle and a collecting surface;
- collecting electro spun material coming from the nozzle so as to form a fibrous structure on the collecting surface;
- distributing positive and/or negative ions onto the fibrous structure by way of one or more electrostatic emitters;
- rotating the collecting surface by means of one or more rotatable bodies causing the collecting surface to face the nozzle and the one or more electrostatic emitters in turn.

Optionally, the method further comprising the step of controlling the electrostatic emitters so as to form a pattern in the fibrous structure.

SHORT DESCRIPTION OF DRAWINGS

Figure 2:
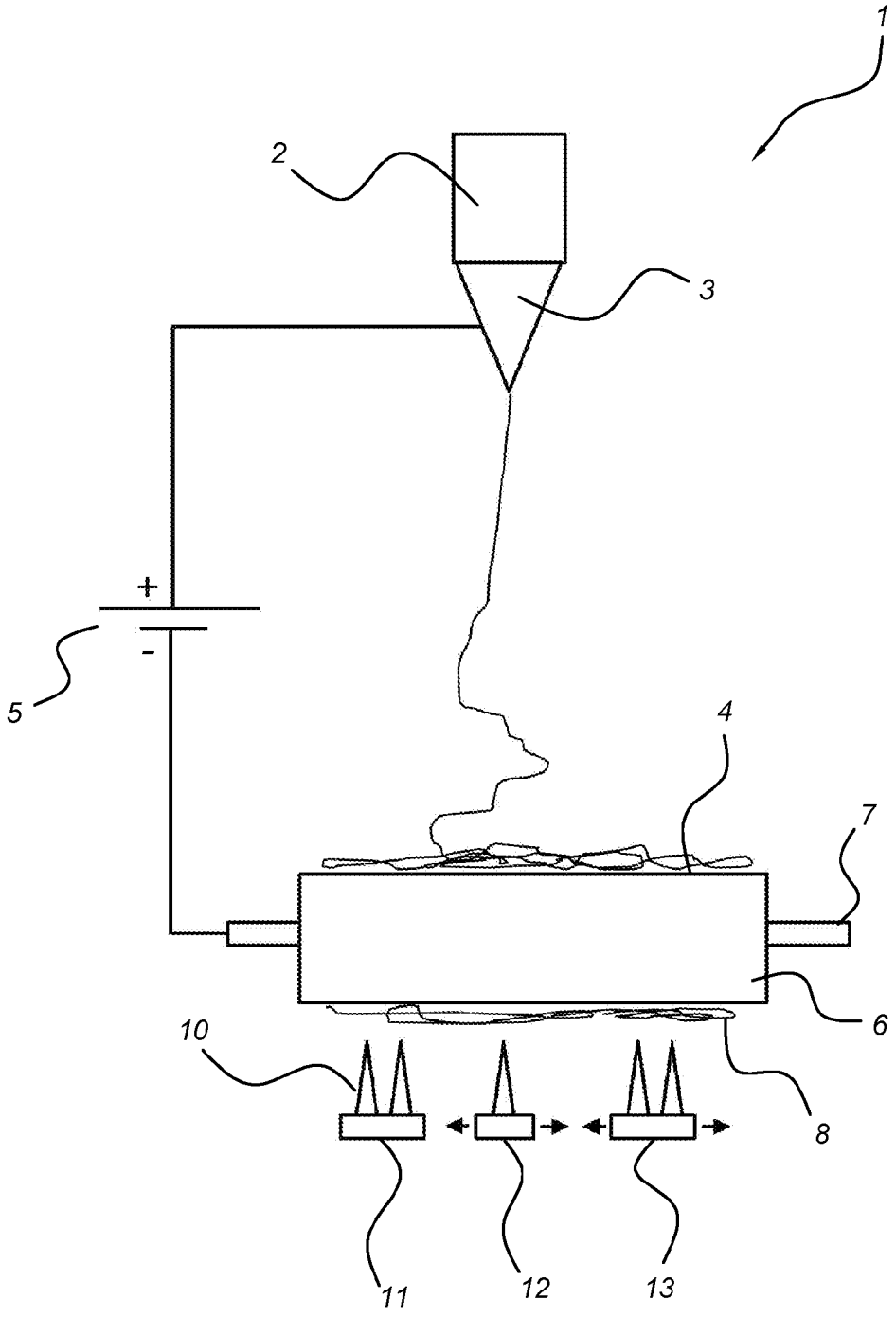
Figure 3:
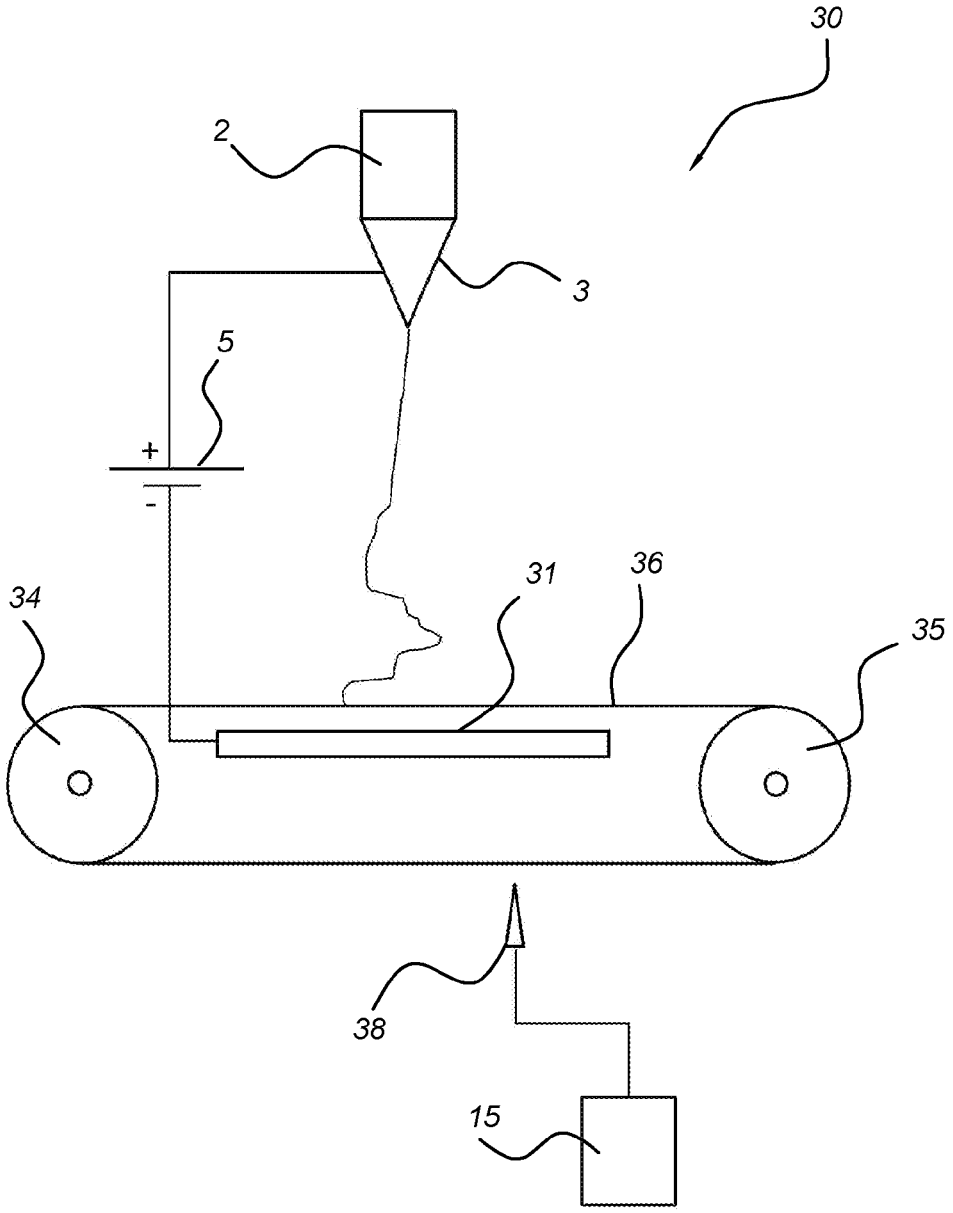
Figure 4:
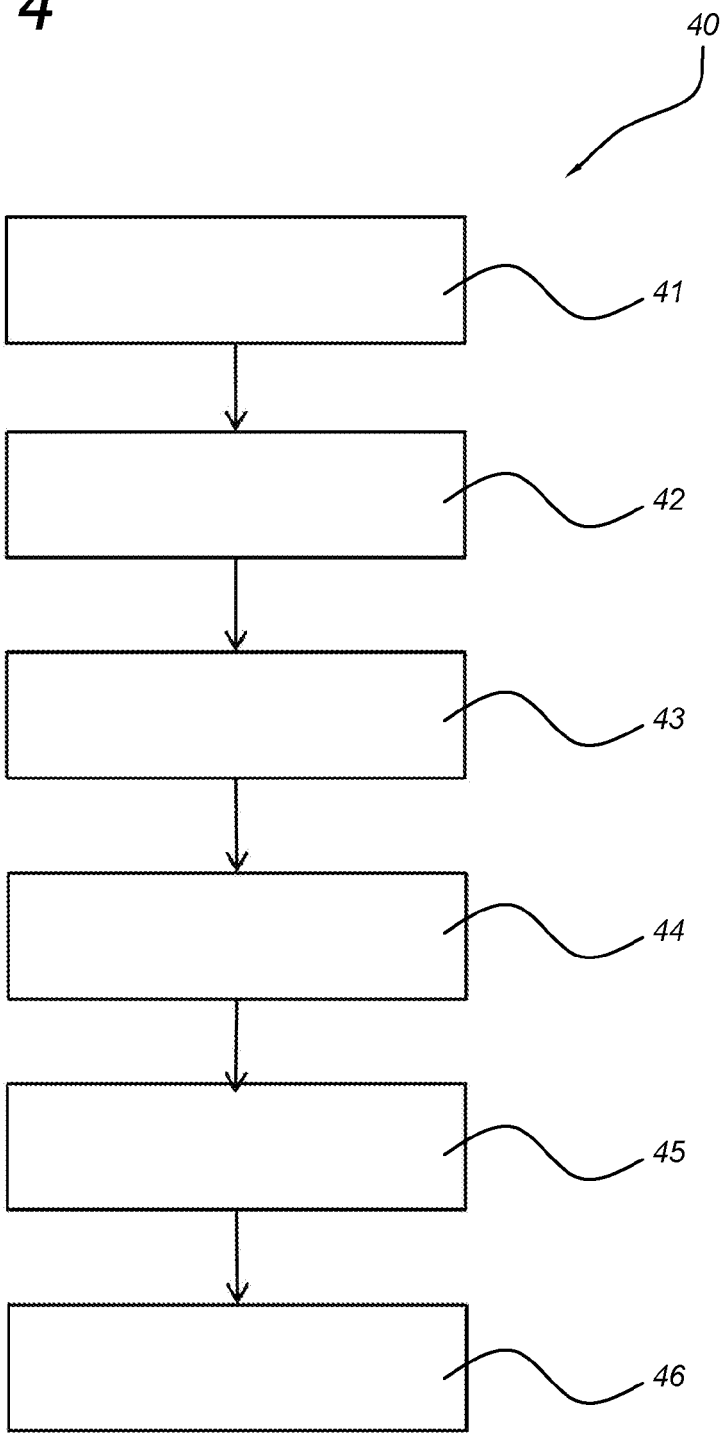

These and other aspects of the invention are apparent from and will be elucidated with reference to the embodiments described hereinafter. In the drawings, FIG. 1 schematically shows an embodiment of an electrospinning device;

FIG. 2 schematically shows an electrospinning device according to an embodiment of the invention;

FIG. 3 schematically shows an electrospinning device according to a further embodiment of the invention;

FIG. 4 shows a flow chart of a method of electrospinning according to a further aspect of the invention.

DESCRIPTION OF EMBODIMENTS

FIG. 1 schematically shows an embodiment of an electrospinning device 1. The electrospinning device 1 may be arranged inside an enclosure (not shown in FIG. 1) for quality or security reasons. The electrospinning device 1 may comprises a container 2 for holding a liquid comprising a polymer melt or a polymer solution, and a nozzle 3 arranged to outlet a stream of the liquid from the container 2. The electrospinning device 1 further comprises a collecting surface 4 for collecting electro spun material coming from the nozzle 3 during an electrospinning process. A voltage supply system 5 may be arranged to create a voltage difference between the nozzle and the collector. The voltage supply system 5 may comprise at least one AC or DC voltage supply to create the voltage difference or it may comprise two voltage supplies, one creating a voltage difference between the collecting surface 4 and ground and one creating a difference between the nozzle 3 and ground. Due to the applied voltage(s), an electro spun fiber is created that flies from the nozzle 3 to the collecting surface 4 on which it is collected to form an electro spun fibrous structure 8.

In the embodiment shown in FIG. 1 the device 1 also comprises one or more electrostatic emitters 10 arranged to locally distribute positive and/or negative ions onto the fibrous structure and/or collector, thereby locally changing the charge of the fibrous structure 8, and so attract or repel the incoming 'flying' fibers. The electrostatic emitters 10 are, for example, electrostatic emitters (ionizers) such as ion generators. Furthermore, the device 1 comprises a rotatable body 6 arranged to cause the collecting surface to face the nozzle 3 and the static emitters 10 in turn (or alternately in position, and hence during operation also alternately in time). In this embodiment, the rotatable body is a rotatable cylindrical body 6, the surface of which forms the collecting surface 4. The rotatable cylindrical body 6 is arranged on a shaft 7 which is driven by a motor (not shown).

In the embodiment shown in FIG. 1 the static emitters 10 are arranged in a row. In the example of FIG. 1, the static emitters 10 are arranged in an array with equidistant space between two consecutive static emitters 10. Each static emitter 10 is arranged to distribute positive and/or negative ions on the fibrous structure 8 over a distance Di. This distance is smaller than the width W of the rotatable cylindrical body 6, and thus smaller than the width of the collecting surface 4. It is noted that in other embodiments, the static emitters 10 can be arranged having arbitrary intermediate spaces, i.e. non-equidistant spaces. The electrostatic emitters 10 may be relatively small, and positioned close to the surface of the collecting surface 4 (and thus fibrous structure 8). The electrostatic emitters are e.g. pin or spike formed, and may have an effective area around the emitters 10 with a radius of only 5-10 mm.

The device 1 may also comprise a control unit 15 arranged to control the static emitters 10 so as to create a pattern into the fibrous structure 8, as will be explained below.

For example, when the tip portion of the nozzle 3 is positively charged, the fibrous structure 8 deposited on the collecting surface 4 has a positive charge. In such a case, since the positively charged fibers 8 repel each other, it is difficult to deposit the fibers consecutively. By locally distributing negative ions on the fiber structure 8, using the negative ion generator, the positive charges of the already deposited fibers can be locally neutralized. As a consequence, once the collecting surface faces the nozzle 3 again, at these locally neutralized locations, the fibers will be attracted, while at the still positively charged locations, the new fibers will be repelled. In this way a pattern can be created into the fiber structure. It is noted that instead of neutralizing certain locations of the fibrous structure, they can be charged negative, giving the same or sometimes even better results.

FIG. 2 schematically shows an electrospinning device 1 according to an embodiment of the invention. The device 1 is similar to the device shown in FIG. 1, except that in FIG. 2 the static emitters 10 are movable in a direction parallel to a rotation axis of the rotatable body 6, i.e. parallel to the longitudinal direction of the shaft 7. This is indicated by arrows. In this example some static emitters 11 are stationary, some are movable individually, see 12, and some are movable jointly, see 13. It will be clear to the skilled reader that many combinations of movable and non-movable (static) static emitters are conceivable.

As mentioned above with reference to FIG. 1, by providing positive or negative ions onto the fibrous structure respectively collecting surface, the fibrous structure is locally charged or discharged. The control unit 15 may be arranged to control the static emitters 10 so as to create a pattern into the fibrous structure 8. For example, in a first stage, the control unit 15 may equally activate all of the static emitters 10, which may cover the whole of the width W of the collecting surface 4. This will result in a substantially flat layer of fibers on the collecting surface 4. In a second stage, the control unit 15 may activate two of the static emitters 10 remote from each other with a distance L, and having an effective discharge area of Di and Dj. Once the second stage progresses, the fibrous structure will contain a bottom layer with two rims on it having a real valued distance K of about K=L−Di/2−Dj/2. In this way all kind of pattern with rings can be manufactured. By switching between the individual emitters during the rotation of the collector other projected patterns (not limited by) like squares, stripes and circles are possible.

FIG. 3 schematically shows an electrospinning device 30 according to a further embodiment of the invention. The device 30 comprises two rotatable bodies 34, 35, and a looped conveyer belt 36 arranged around the two rotatable bodies 34, 35, wherein the surface of the belt 36 forms the collecting surface/carrier for the fibrous mesh 4. In the embodiment of FIG. 3, the device 30 also comprises a counter electrode 31. By applying a voltage difference between the nozzle 3 and the counter electrode 31, an electrical field is created between the nozzle 3 and the collecting surface 4 when situated between the nozzle 3 and the electrode 31. The electrode 31 may have all sorts of configurations such as for example beam shaped or plate shaped. In an embodiment the belt 36 will be made of a polymer and thus exhibit electrically insulating properties. The belt 36 should be thin enough for the electric field to pas-trough, but intrinsically will limit the release of charge from the fibrous structure to the counter electrode 31. It is noted that more than two rotatable bodies may be used to guide the belt 36 along the collecting location, the charge or discharge location, and possible some other locations for additional processing of the fibrous structure.

FIG. 3 shows an electrostatic emitter 38, which represents a whole row of a number of electrostatic emitters 38 arranged along the surface of the belt in a direction parallel to a rotation axis of the rotatable bodies 34, 35. Although a number of electrostatic emitters 38 are preferred, only a single electrostatic emitter 38 will already produce a pattern in the fibrous structure. The same accounts for the number of electrostatic emitters 10 of FIGS. 1 and 2.

In the embodiments shown in FIG. 1-3 the collecting surface 4 is arranged between the nozzle 3 and the one or more electrostatic emitters 10, 38. This allows to have the collecting surface 4, in combination with the rotatable bodies 6, to face, in turn (i.e. subsequently), the nozzle 3 and the one or more electrostatic emitters 10, 38. Furthermore, as the electrostatic emitters 10, 38 are located at the opposite side from the collecting surface 4 when viewed from the nozzle 3, the electrostatic emitters 10, 38 will have less influence on the area in the electrospinning device where the fibers are formed from the jet exiting the nozzles 3, i.e. the Rayleigh instability area. Alternative arrangements are conceivable, as long as the positioning of the electrostatic emitters 10, 38 is such that the formed fibrous structure 8 on the collecting surface 4 is facing the nozzle 3 and the electrostatic emitters 10, 38 in turn (i.e. subsequently during operation).

FIG. 4 shows a flow chart of a method of electrospinning 40 according to a further aspect of the invention. The method 40 comprise holding, see step 41, a liquid comprising a polymer melt or a polymer solution in a container. Furthermore the method comprises letting out, see step 42, a stream of the liquid from the container through a nozzle 3. Furthermore the method comprises creating 43 a voltage difference between the nozzle and a collecting surface. Furthermore the method comprises collecting, see step 44, electro spun material coming from the nozzle so as to form a fibrous structure on the collecting surface. Furthermore the method comprises locally distributing, see step 45, positive and/or negative ions onto the fibrous layer by way of one or more static emitters.

Finally, the method comprises rotating the collecting surface by means of one or more rotatable bodies, see step 46, causing the collecting surface to face the nozzle and the one or more static emitters 10 alternately.

The method shown in FIG. 4 may also comprise the step of controlling the static emitters so as to form a pattern in the fibrous structure.

It should be noted that the above-mentioned embodiments illustrate rather than limit the invention, and that those skilled in the art will be able to design many alternative embodiments. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. In the device claims several means are enumerated. These means may be embodied by one and the same item of hardware or software. The mere fact that certain measures are recited in mutually different dependent claims does not indicate that a combination of these measures cannot be used to advantage.

The invention claimed is:

1. An electrospinning device comprising:

a container for holding a liquid comprising a polymer melt or a polymer solution;

a nozzle arranged to outlet a stream of the liquid from the container;

a collecting surface for collecting electro spun material coming from the nozzle during an electrospinning process so as to form a fibrous structure on the collecting surface;

a voltage supply system arranged to create a voltage difference between the nozzle and the collecting surface, one or more electrostatic emitters arranged to locally distribute positive and/or negative ions onto the fibrous structure, one or more rotatable bodies arranged to cause the collecting surface to face the nozzle and the electrostatic emitters in turn, and a control unit arranged to control the electrostatic emitters so as to control an attractiveness or repulsiveness of certain areas of the collector or of the fibrous structure for subsequent fiber deposition to form a local buildup of fibers to create a pattern in the fibrous structure.

2. The electrospinning device according to claim 1, wherein the device comprises a rotatable cylindrical body, the surface of which forms the collecting surface.

3. The electrospinning device according to claim 1, wherein the device comprises at least two rotatable bodies, and a looped conveyer belt arranged around the two rotatable bodies, wherein the surface of the belt forms the collecting surface.

4. The electrospinning device according to claim 1, wherein the collecting surface is arranged between the nozzle and the one or more electrostatic emitters.

5. The electrospinning device according to claim 1, wherein the electrostatic emitters are arranged in a row.

6. The electrospinning device according to claim 5, wherein the electrostatic emitters are arranged in an array.

7. The electrospinning device according to claim 1, wherein the electrostatic emitters are movable in a direction parallel to a rotation axis of the rotatable body or bodies.

8. The electrospinning device according to claim 1, wherein the electrostatic emitters comprise ion generators.

9. A method of electrospinning comprising:

holding a liquid comprising a polymer melt or a polymer solution in a container;

letting out a stream of the liquid from the container through at least one nozzle;

creating a voltage difference between the nozzle and a collecting surface;

collecting electro spun material coming from the nozzle so as to form a fibrous structure on the collecting surface;

distributing positive and/or negative ions onto the fibrous structure, respectively collecting surface by way of one or more electrostatic emitters, and controlling the electrostatic emitters so as to control an attractiveness or repulsiveness of certain areas of the collector or of the fibrous structure for subsequent fiber deposition to form a local buildup of fibers to create a pattern in the fibrous structure; and rotating the collecting surface by means of one or more rotatable bodies causing the collecting surface to face the nozzle and the one or more electrostatic emitters in turn.

* * * * *